United States Patent [19]

Nakamura et al.

[11] 4,230,743

[45] Oct. 28, 1980

[54] PROCESS FOR PRODUCING PRESSURE-SENSITIVE COPYING PAPER

[75] Inventors: Hiroaki Nakamura; Shiro Kaneko; Takeshi Watanabe, all of Shizuoka, Japan

[73] Assignee: Fuji Photo Film Co., Ltd., Minami-ashigara, Japan

[21] Appl. No.: 878,353

[22] Filed: Feb. 16, 1978

Related U.S. Application Data

[63] Continuation-in-part of Ser. No. 810,700, Jun. 28, 1977, abandoned.

[30] Foreign Application Priority Data

Jun. 28, 1976 [JP] Japan ..... 51-76743

[51] Int. Cl.[2] ..... B41M 5/12; B41L 1/00

[52] U.S. Cl. ..... 427/146; 282/27.5; 427/150; 427/151; 427/152; 427/420

[58] Field of Search ..... 427/150, 407 R, 420, 427/214, 391, 402, 411, 424, 426, 146, 151, 152; 282/27.5; 118/300, 324, 403, 412

[56] References Cited

U.S. PATENT DOCUMENTS

| | | | |
|---|---|---|---|
| 3,205,089 | 9/1965 | Kinzelman | 427/420 |
| 3,461,840 | 8/1969 | Turner | 427/420 X |
| 3,508,947 | 3/1970 | Hughes | 427/358 X |
| 3,632,374 | 1/1972 | Greiller | 96/85 |
| 3,955,026 | 5/1976 | Matsukawa et al. | 427/150 X |
| 3,963,852 | 6/1976 | Baxter | 427/150 |
| 3,970,769 | 7/1976 | Kato et al. | 427/150 X |
| 4,038,445 | 7/1977 | Robertson | 427/150 |
| 4,041,897 | 8/1977 | Ade | 427/420 X |
| 4,051,303 | 9/1977 | Hayashi et al. | 427/150 X |

FOREIGN PATENT DOCUMENTS

| | | | |
|---|---|---|---|
| 838392 | 6/1960 | United Kingdom | 427/420 |

*Primary Examiner*—Shrive P. Beck
*Attorney, Agent, or Firm*—Sughrue, Rothwell, Mion, Zinn and Macpeak

[57] ABSTRACT

A process for producing a pressure-sensitive copying paper which comprises forming a single-layer, free-fall, vertical curtain of a coating solution containing microcapsules as a main component and coating the coating solution onto a continuously running web across the single-layer, free-fall, vertical curtain and a process for producing a pressure-sensitive copying paper which comprises forming a dual-layer, free-fall, vertical curtain of a coating solution containing microcapsules as a main component and a coating solution containing a color developer as a main component and coating the coating solutions onto a continuously running web across the dual-layer, free-fall, vertical curtain.

20 Claims, 6 Drawing Figures

PROCESS FOR PRODUCING PRESSURE-SENSITIVE COPYING PAPER

This application is a Continuation-in-Part application of Ser. No. 810,700, filed June 28, 1977 now abandoned.

BACKGROUND OF THE INVENTION

1. Field of the Invention

The present invention relates to a process for producing a pressure-sensitive copying paper. In more detail, the present invention relates to a process for producing a pressure-sensitive copying paper which comprises coating a coating solution for a pressure-sensitive copying paper onto a long support (hereafter referred to as a "web") which is continuously running.

2. Description of the Prior Art

Known types of pressure-sensitive copying papers include types comprising a support having thereon a coating layer comprising microcapsules, a binder and a protective agent on one side thereof and a coating layer containing a color developer as a main component on the other side thereof, and types comprising a support having thereon only either a coating layer comprising microcapsules, a binder and a protective agent or a coating layer containing a color developer as a main component on one side thereof. These types are utilized by contacting the coating layer containing microcapsules face-to-face with the coating layer containing a color developer.

The reason why a protective agent is incorporated is to prevent the pressure-sensitive copying paper from being stained due to the formation of an undesired coloration caused by pressure or abrasion occurring during handling, rather than the letter marking for which the paper is designed, prematurely rupturing the microcapsules and as a result a color former in the destroyed microcapsules reacts with a color developer to form a color.

In this case, an air knife coating method (for example, as described in U.S. Pat. Nos. 3,186,851 and 3,472,674, British Pat. No. 1,176,469, etc.) or a blade coating method (for example, as described in Japanese Patent Publication 35330/74, British Pat. No. 1,339,082, etc.) have hitherto been employed exclusively as a coating means. Such methods all comprise coating an excess amount of a coating solution onto a web and then scraping the excess coating solution off by means of an air knife or a blade, thereby adjusting the coating to a desired amount of the coating solution and at the same time, the scraped off coating solution is recovered and recirculated for reuse.

It is believed the reason such coating methods have been exclusively employed is because these methods enable thin layer coating at a high speed above 300 m/min. using a relatively simple operation and because a very high quality is not required for the products per se.

However, it is impossible to sufficiently achieve the function of a protective agent as mentioned above, when such coating methods are employed. That is, in the case of an air knife coating method, a protective agent of a large particle size is scraped off to a greater extent by a classification effect due to the air knife; also in the case of a blade coating method, a classification effect occurs at the spacing between the blade and the web, and a protective agent which has a high probability of contact with the blade is scraped off to a greater extent. It is extremely difficult to coat the protective agent in a desired amount, ultimately. In addition, this classification effect due to an air knife or a blade becomes more remarkable as the coating speed increases so that it is actually impossible to comply with recent demands for increases in production rates.

Furthermore, in general, the excess amount of the coating solution which is scraped off with an air knife or a blade is recovered and recirculated for reuse. However, the concentration of solid materials in the coating solution is gradually increased by the above-mentioned classification effect so that a coating composition changes with the passage of time. Therefore, it is extremely difficult to coat a coating solution with a constant composition on a web over a long period of time. It is thus impossible to prepare a pressure-sensitive copying paper of high quality.

In addition, the protective agent must be present near the surface of a coated layer, since the function of the protective agent is to protect the microcapsules from pressure or abrasion other than the localized pressure employed when such is used. However, the protective agent which is scraped off because of the above-mentioned classification effect is present near the surface of a coated layer. Accordingly, there is a problem that a sufficient protective effect is not obtained with a pressure-sensitive copying paper prepared by such methods.

In addition, there is a defect that copying capability as a pressure-sensitive copying paper is remarkably deteriorated, since all of these methods involve previously coating a coating solution on a web in a large amount and scraping the excess of the coating solution off and adjusting the amount to the coating amount desired and the coating solution permiates into the web to cause the web to swell.

Furthermore, in the case of an air knife coating method, the defects that not only is recovery difficult because the coating solution scraped off with an air knife is converted to a fine mist, e.g., very fine droplets, as the coating speed increases, and at the same time, the working environment is polluted or the edge of the air knife is contaminated causing streaks on the coated surface to occur, but also a limitation in the viscosity of the coating solution exists and a sufficient effect cannot be achieved in adjusting the amount of the coating solution having a high concentration and a high viscosity coated, and the like. In addition, in the case of a blade coating method, defects are also observed that coating for a long period of time in a stable manner becomes difficult due to abrasion of the blade and contamination of the blade.

Further, as mentioned above, it is desired for a pressure-sensitive copying paper not to be colored in handling and to color only when appropriately used. Conversely, efficient coloration upon appropriate use such as letter marking or the like must occur. For this purpose, the pressure-sensitive copying paper must have the characteristics that it is colored when a definite amount of pressure is applied but it is not colored when less than a certain amount of pressure is applied. Such a characteristic cannot be achieved with a pressure-sensitive copying paper prepared in accordance with conventional methods since the protective agent is selectively scraped off due to the classification effect as mentioned above.

Recently, a self-contained type pressure-sensitive copying paper has been employed which comprises a support having provided, on one side only, a coating layer containing microcapsules as a main component, as a lower layer, and a coating layer containing a color developer as a main component, as an upper layer. However, such a self-contained type pressure-sensitive copying paper is extremely complex and is uneconomical since it is prepared by a method which comprises coating a coating solution containing microcapsules as a main component on a web to form a coated layer, drying the coated layer and coating a coating solution containing a color developer as a main component on the above-mentioned coated layer to form a coated layer and then drying the coated layer, and thus two coating steps and two drying steps are involved.

SUMMARY OF THE INVENTION

An object of the present invention is to provide a process for producing a pressure-sensitive copying paper of high quality which eliminates the disadvantages of conventional techniques and has a more even quality.

Another object of the present invention is to provide a process for producing a pressure-sensitive copying paper with which coloration in handling other than when occurs with difficulty.

A further object of the present invention is to provide a process for effectively producing a self-contained type pressure-sensitive copying paper.

Still a further object of the present invention is to provide a process for effectively producing a self-contained type pressure-sensitive copying paper having improved coloring efficiency and pressure-color density relationship.

The objects of the present invention are attained by the process of this invention comprising either forming a single layer, free-fall, vertical curtain comprising a single coating solution composed of microcapsules as a main component and coating the coating solution on a travelling web, or forming dual layer, free-fall, vertical curtains comprising dual layers of a coating solution containing microcapsule as a main component and a coating solution containing a color developer as a main component and coating the dual layer curtains on a travelling web, followed by drying.

DETAILED DESCRIPTION OF THE INVENTION

A method of coating which comprises forming a free-fall curtain(s) of a coating solution(s) and bringing a web into contact with the curtain(s), or a so-called curtain coating method has already been disclosed in Japanese Patent Publication Nos. 24133/74 and 35447/74 (corresponding to U.S. Pat. Nos. 3,508,947 and 3,632,374). It is known that the curtain coating method is suitable for coating a coating solution with a high viscosity, for coating a thin layer and for high speed coating.

The present invention provides a number of advantages by applying such a curtain coating method to the coating of a pressure-sensitive copying paper.

Embodiments of the present invention will be explained in detail with reference to the attached drawings.

Figure 1:
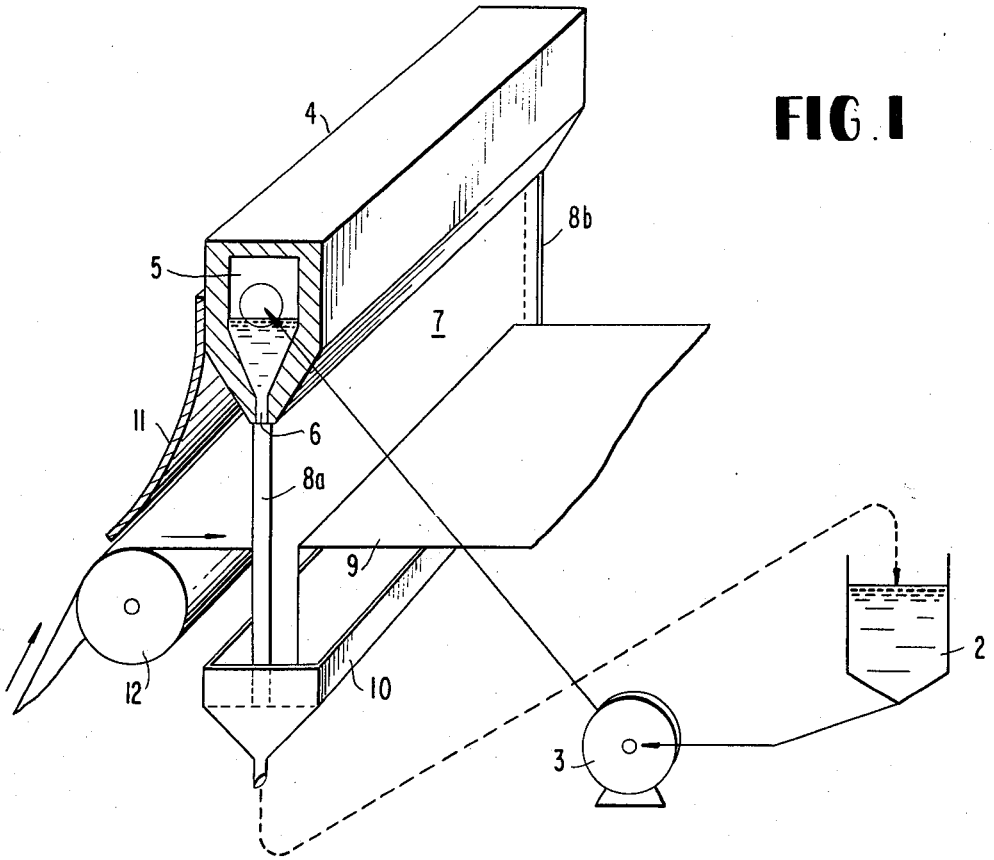
FIG. 1 is a schematic view of an oblique view of a coating apparatus showing an embodiment in accordance with the present invention and FIG. 2 is a detail of the essential part thereof.

Turning now to FIG. 1, FIG. 1 is a schematic view of a coating apparatus for pressure-sensitive copying paper which shows an embodiment of the present invention.

Coating solution 1 containing microcapsules as a main component which is previously prepared is sent from coating solution vessel 2 to solution-supplying head 4 through a metering pump 3. The amount of the coating solution sent is proportional to the coated amount of the final product. Therefore, the amount of the coating solution sent to solution-supplying head 4 should be accurately controlled. A convertible non-pulse flow metering pump is suitable as metering pump 3.

The solution-supplying head 4 has pocket 5 (i.e., a buffer chamber) therein and has a slit 6 of high accuracy. While filling the coating solution 1 supplied in pocket 5, a dynamic pressure upon supplying the coating solution 1 is lost. When a dynamic equilibrium state is reached, the flow amount of coating solution 1 flowing into pocket 5 is completely balanced with the flow amount flowing out from slit 6, thereby the height of the liquid surface in pocket 5 is kept constant so that the coating solution flowing down from slit 6 due to gravity flows out uniformly in the width direction to form a free-fall vertical curtain 7. In this occasion, guide poles 8*a* and 8*b* are provided in order to enhance the stability as a solution layer for curtain 7, as if both edges of the curtain 7 are supported thereby. A suitable width of slit 6 is about 0.1 to about 1.0 mm, preferably 0.2 to 0.6 mm, particularly preferably 0.2 to 0.3 mm.

Free-fall curtain 7 of coating solution 1 comes into contact with web 9 which is running continuously, and thus coating solution 1 is coated on web 9, e.g., in an amount of about 0.6 cc/cm/sec or more, preferably 0.8 cc/cm/sec or more, more preferably 1.0 cc/cm/sec or more. Guide poles 8*a* and 8*b* are provided beyond the width of web 9 and free-fall vertical curtain 7 is formed beyond the width of web 9. Coating solution 1 which flows down beyond the width of web 9 is recovered in a solution-receiving vessel 10 and recycled to coating solution vessel 2. As such, the formation of curtain 7 beyond the width of curtain 7 is to prevent thick coating of a coated layer which usually occurs at both ends of curtain 7. In addition, air flow accompanying web 9 is shielded by providing wind shielding plate 11 at an upper flow side of contact areas (hereafter referred to as "coating area") of free-fall curtain 7 and web 9 so that free-fall curtain 7 surely reaches web 9 without free-fall curtain 7 being disturbed. Further, the arrangement is such that the influence of the air flow accompanying the coating area is minimized by changing the running direction of web 9 by roller 12 immediately before the coating area. In addition, even when coating is accidentally discontinued, such as when web 9 is cut, coating solution 1 is recovered in solution-receiving vessel 10.

The web after coating is dried and wound up in a manner similar to conventional methods. Then, the web is cut into an appropriate size depending upon the purpose for use.

As described above, in the embodiment of the present invention, the amount of the coating solution is premeasured by measuring the amount of the coating solution to be sent into solution-supplying head 4 prior to coating. Therefore, since there is no opportunity to determine the amount of the coating solution using an air knife or a blade after coating, solid particles of the protective agent around the surface of the coated layer are not selectively scraped off due to a classification effect. Thus, the desired coloration conditions can be established because a coated layer having a desired composition can be formed. In addition, it becomes possible to produce a pressure-sensitive copying paper of high quality because the composition of the coating solution does not change with the passage of time even when the coating solution is recirculated and reused. Such effects can be maintained even at an increased coating speed.

In addition, the amount of the coating solution is supplied to a coating apparatus after the amount has been preset so that the amount is limited to the amount necessary for coating and an excess amount of the coating solution is not provided on the web as in an air knife or blade coating method. Accordingly, the coating solution does not swell the web nor decrease the copying capability of the pressure-sensitive copying paper. In general, the amount of the coating solution to be supplied becomes less than ½ that employed using the prior art air knife method or doctor blade method. Also, in a so-called curtain coating method in which a free-fall vertical curtain is brought into contact with a web, the coating amount is determined by the ratio of the coating amount to be supplied per unit time to the running speed of web 9. However, the minimum value of the amount of the coating solution to be supplied is theoretically that amount of coating solution necessary to form a stable free-fall vertical curtain. Thin layer coating, i.e., holding down the coating amount to an extremely small amount, is thus possible since the theoretical amount is extremely small and the coating speed is generally sufficient even at about 1,000 m/min. This enables the drying load to be decreased, at the same time.

It has also been found that the coloring efficiency and pressure-color density relationship of the pressure-sensitive copying paper produced in accordance with the present invention is improved. The pressures generally applied to a pressure-sensitive copying paper to form the color image range from 100 to 400 kg/cm$^2$ and principally range from 150 to 300 kg/cm$^2$. It has been found that the coloring density of a pressure-sensitive paper produced using the free-fall vertical curtain method of coating is extremely higher than for a paper produced by the air-knife and blade coating methods over the range of pressures generally applied in forming images. The pressure-color density relationship is the relationship between the change in color density with a change in applied pressure. Hereafter this property will be referred to as the "P-D property". When the free-fall vertical curtain coating technique is used, the P-D property is improved within the generally applied pressure range. These improvements in color efficiency and P-D property are exceptional for commercial quality pressure-sensitive copying papers.

The surface quality of the pressure-sensitive copying paper produced in accordance with the present invention is also superior to that of the air-knife coated paper. Generally a high surface smoothness is required of pressure-sensitive recording paper to obtain high quality printing. However, it is difficult to obtain high surface quality because a pressure-sensitive copying paper cannot be subjected to conventional surface smoothing treatments such as calendering which tends to scum the surface of the paper. This scumming cannot be easily prevented. On the other hand, the surface quality of a paper produced using the free-fall vertical curtain coating method is good without subjecting the paper to conventional smoothing treatments such as calendering.

Figure 3:
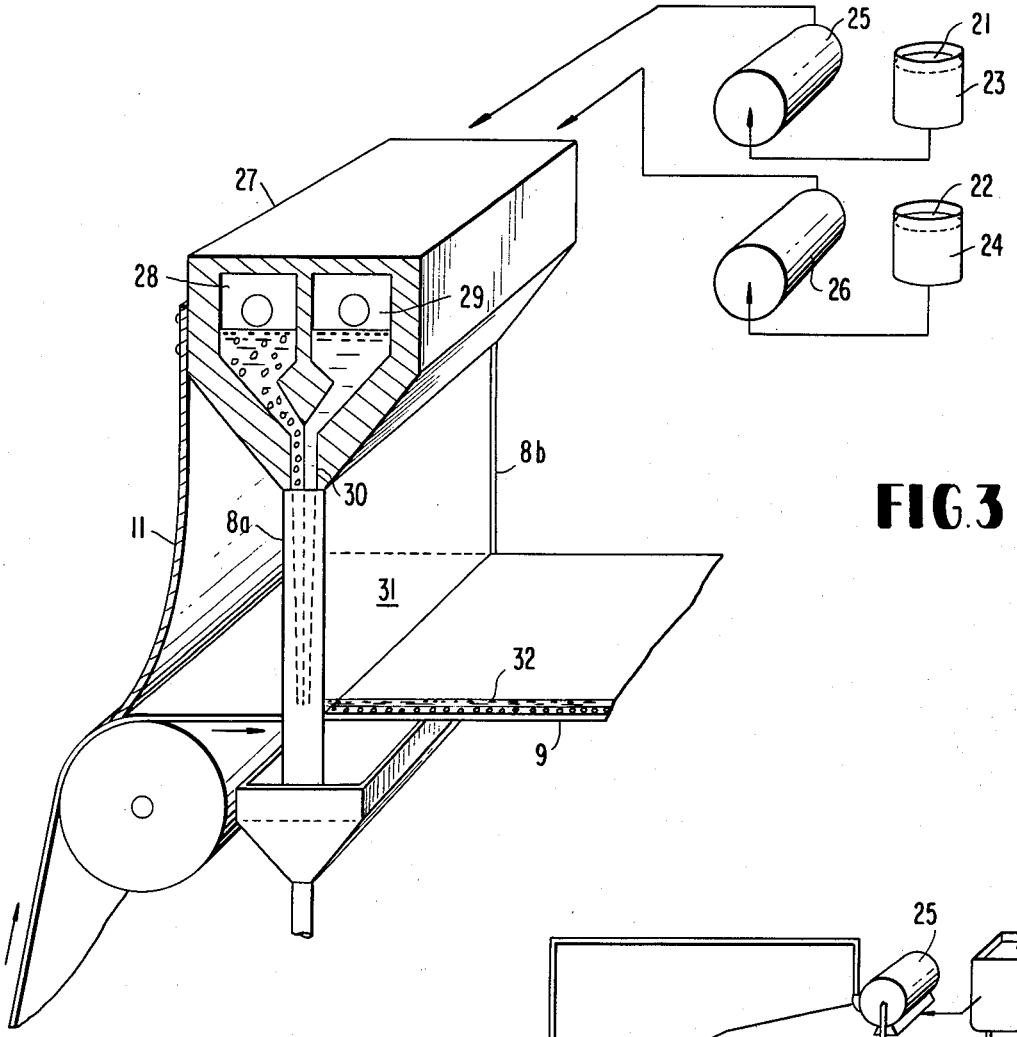
FIG. 3 and FIG. 4 each is a schematic view of a coating apparatus showing another embodiment in accordance with the present invention.

FIG. 3 is a schematic view of a coating apparatus for producing pressure-sensitive copying paper which shows another embodiment of the present invention.

In FIG. 3, a coating solution comprising microcapsules, a binder and a protective agent as a lower layer and a coating solution containing a color developer as a main component, as an upper layer, are simultaneously coated in dual layers. Coating solution 21 comprising microcapsules previously prepared, a binder, and a protective agent and coating solution 22 containing a color developer as a main component are supplied from coating solution vessels 23 and 24 into solution-supplying head 27 through metering pumps 25 and 26, respectively. Solution-supplying head 27 is composed of two pockets 28 and 29. Coating solution 21 comprising microcapsules, a binder and a protective agent is supplied into pocket 28 and coating solution 22 containing a color developer as a main component is supplied into pocket 29, respectively. Both pockets 28 and 29 come together at a lower portion thereof. A single slit 30 is provided below the portion where the solutions come together. The respective coating solutions are filled into each of pockets 28 and 29. When a dynamic equilibrium state is reached, both coating solutions flow out from slit 30 into the width direction in a uniform flow amount because they exist as dual layers. Both coating solutions which flow out from slit 30 form a dual layer free-fall curtain 31 along with guide poles 8*a* and 8*b* while the dual layer state is maintained. This free-fall curtain 31 comes into contact with web 9 which is continuously running, to form coated layer 32 of the dual layers on web 9. A suitable width of slit 9 due to the dual layer coating in this embodiment is in theory about twice the embodiment described in FIGS. 1 and 2 above. However, it is possible to obtain an amount of coating solutions sufficient to form a free-fall vertical curtain even using a narrower width slit, because a dual layer coating is accomplished simultaneously. Therefore, a sufficient width of slit 30 in dual layer coating can be less than twice that in single layer coating.

It has been confirmed that a self-contained type pressure-sensitive copying paper prepared using the method described above exhibits a coloring efficiency and P-D property superior to that of a self-contained type pressure-sensitive copying paper prepared in accordance with conventional methods. Furthermore, the surface quality of the paper is better than that produced conventionally.

According to the method of this invention, the processing steps are simplified since drying after each coating is not required. In addition, a free-fall vertical curtain is sufficiently maintained because of simultaneous dual layer coating even if the amount of respective coating solutions is reduced as compared to the case in which coating is made by independently forming free-fall vertical curtains, respectively. Therefore, there are substantial advantages that not only is copying efficiency as a pressure-sensitive copying paper not reduced since a swelling of the web does not occur, but also the drying load can be even further reduced.

Figure 4:
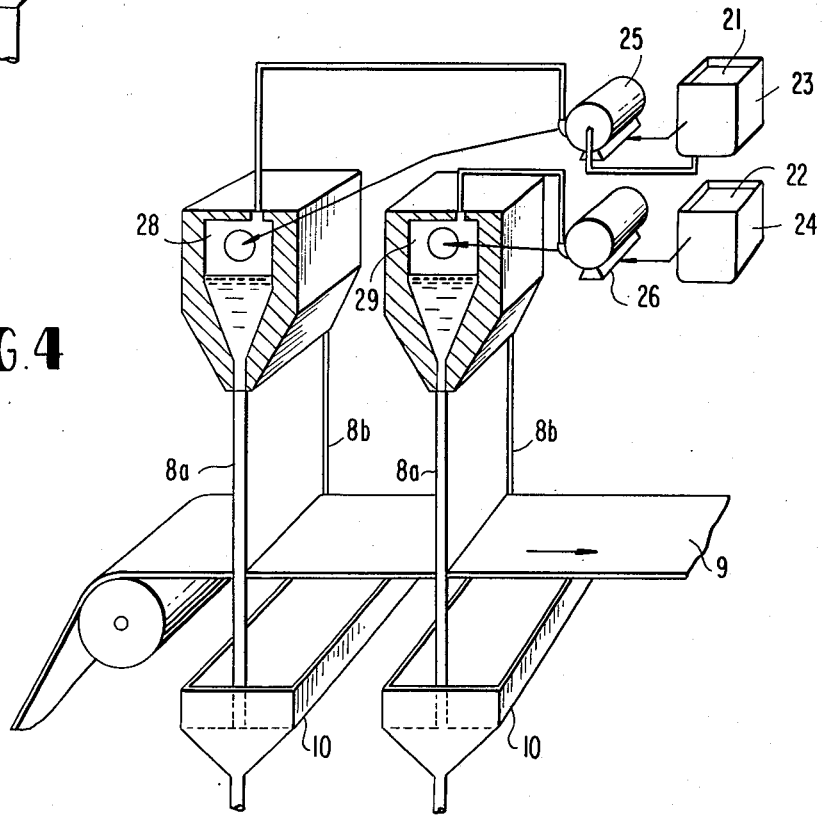

FIG. 4 is a schematic view of another embodiment of the present invention.

Figure 2:
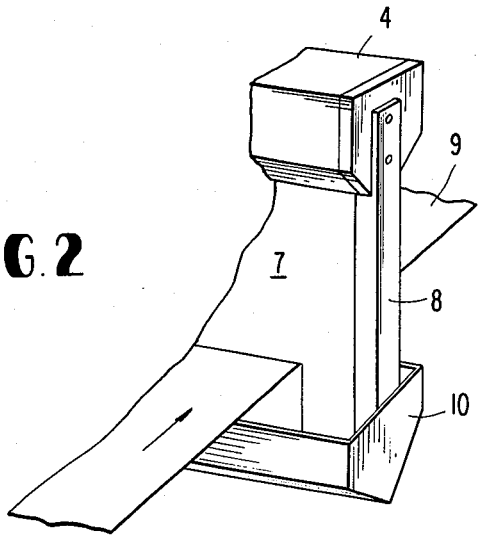

In FIG. 4, the coating apparatus shown in FIGS. 1 or 2 is set up in series. In the first coating apparatus, coating solution 21 containing microcapsules as a main component is coated on web 9 in a quite similar manner to that shown in FIG. 1 or FIG. 2. Before the coated layer comprising microcapsules as a main component has dried, coating solution 22 containing a color developer as a main component is further coated in a dual layer relationship using the second coating apparatus. The thus-obtained pressure-sensitive copying paper has the same characteristics as those obtained using the coating apparatus shown in FIG. 3.

According to these embodiments, in addition to the advantages described with respect to the individual embodiments, there is the important advantage that high speed thin layer coating is possible. That is, the curtain coating method is extremely suitable for high speed coating. It is said that the upper limit of the coating speed is about 1,000 m/min or that there is no limit in theory. The curtain coating method enables thin layer coating of a coated layer thickness of several microns and is extremely suitable for coating of a pressure-sensitive copying paper.

Needless to say, various modifications are possible in the present invention and the invention is not to be construed as being limited to the embodiments specifically described above.

For example, while the explanation has been made only with reference to a so-called extrusion type solution supplying head in the embodiments mentioned above, the solution supplying head is not necessarily limited thereto. It is also possible to employ a so-called slide type solution supplying head or a hopper as disclosed in Japanese Patent Publication Nos. 24133/74 and 35447/74 (corresponding to U.S. Pat. Nos. 3,508,947 and 3,632,374), etc. The present invention includes the case in which such a solution supplying head is employed.

In addition, in the above embodiment the width of the free-fall vertical curtain is set wider than the width of web 9. However, the width can be equal to the width of web 9 or somewhat smaller than that, where the thick coating is small or is insignificant, or it is eliminated by adopting a method as disclosed in Japanese Patent Application No. (OPI) 14130/74 (corresponding to U.S. Pat. No. 3,632,403) or other methods of preventing the occurrence of thick coating.

Although a second coating layer is formed on a first coating layer in the embodiment as shown in FIG. 4 while the first coating layer is in an undried state, the practice of the present invention is not disturbed if, after drying of the first coating layer is completed, a second coating layer is coated in a dual layer relationship, followed by drying. According to this method, although an extra drying step is unavoidable, the defect based on the classification effect inherent in conventional coating methods and the defect of the coating of a large amount of a coating solution and subsequent removal of some of the coating can be eliminated.

In the present invention, the term "coating solution containing microcapsules as a main component" generally refers to a coating solution comprising microcapsules dissolved or dispersed in water with a binder and a protective agent. A suitable viscosity for the coating solution can range from about 10 to about 200, preferably 20 to 100, centipoises at about 15° to 25° C. The concentration of the microcapsules, the binder and the protective agent are about 10 to about 60 wt%. The weight ratios of the microcapsules, the binder and the protective agent are such that the binder and the protective agent are present in an amount of at least about 5 parts by weight, preferably 10 to 70 parts by weight, more preferably 30 to 60 parts by weight, based on 100 parts by weight of the microcapsules; the weight ratios of the binder and the protective agent are such that the protective agent is present in an amount of about 50 to about 200 parts by weight based on 100 parts by weight of the binder.

In addition, in the case of a self-contained type pressure-sensitive copying paper, a protective agent is sometimes not incorporated in the coating as will be mentioned hereafter. In such a case, the coating solution containing microcapsules as a main component refers to a coating solution comprising microcapsules to the binder. In this case, suitable ratios of microcapsules to the binder are about 5 to 70 parts by weight based on 100 parts by weight of the microcapsules.

In the embodiment of the invention illustrated in FIG. 3, the coating solution contains a protective agent. Protective agents, however, are not always necessary. The coating solution can be prepared using only microcapsules and binder. The protective agent generally cannot be eliminated when using the conventional air-knife or blade coating methods. Using these conventional procedures the coated web is generally wound up after applying the microcapsule layer and then conveyed to a second station where it is unwound and coated with the color developer. During these winding and unwinding operations the microcapsules provided on the web are subject to breakage and, accordingly, their protection by the protective agent is generally necessary. On the other hand, in accordance with the present invention the microcapsules and color developer are generally applied from one station and the color developer layer serves to protect the microcapsules against breakage. Accordingly, in accordance with the the present invention the protective agent can be eliminated as shown in FIG. 4 resulting in a substantial cost reduction. Not only must the protective agent be present with the conventional coating methods but the protective agent itself must be processed to a uniform particle size in order to prevent the classification effect discussed above.

In the present invention, the term "microcapsule" refers to a minute capsule in which an oleophilic substance having dissolved therein a basic colorless color former is employed as a material to be encapsulated and such is encapsulated with a wall forming material comprising a high molecular weight material which is insoluble both in water and in an oleophilic solution, and refers to microcapsules having an average particle size of about 0.1 to about 100$\mu$. A combination of a polycation and a polyanion such as gelatingum arabic, a condensation type combination such as a polyisocyanate-polyamine combination, and the like can be employed as a wall forming material. Examples of processes of producing such microcapsules a phase separation method from an aqueous solution (e.g., as described in U.S. Pat. No. 2,800,457 and 2,800,458, etc.), an interfacial polymerization method (e.g., as described in Japanese Patent Publications 19574/64, 446/67, 771/67, 2882/67, 2883/67, 8693/67, 9654/67 and 11344/67, British Pat. Nos. 950,443 and 1,046,409, etc.), polymerization of a wall forming material in oil drops (e.g., as described in Japanese Patent Publications 9168/61 and 45133/74, etc.), a melt dispersion cooling method (e.g., as described in British Pat. Nos. 952,807 and 965,074, etc.), and the like.

In the present invention, a color former is a material which has the property of forming a color by donating an electron or accepting a proton such as from an acid. The present invention is not limited in particular to any specific type of color former. Specific examples of these color formers include triaryl methane compounds such as 3,3-bis(p-dimethylaminophenyl)-6-dimethylaminophthalide, i.e., crystal violet lactone, 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3-(2-phenylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-5-dimethylaminophthalide, 3,3-bis(2-phenylindol-3-yl)-5-dimethylaminophthalide, 3-p-dimethylaminophenyl-3-(1-methylpyrol-2-yl)-6-dimethylaminophthalide, etc.; diphenylmethane type compounds such as 4,4'-bis-dimethylaminobenzhydrin benzyl ether, N-halophenylleucoauramine, N-2,4,5-trichlorophenyl leucoauramine, etc.; xanthene type compounds such as rhodamine B-anilinolactam, rhodamine B p-nitroanilinolactam, 7-dimethylamino-2-methoxyfluoran, 7-diethylamino-2-methoxyfluoran, 7-diethylamino-3-methoxyfluoran, 7-diethylamino-3-chlorofluoran, 7-diethylamino-3-chloro-2-methylfuuoran, 7-diethylamino-2,2'-dimethylfluoran, 7-diethylamino-3-acetylaminofluoran, 7-diethylamino-3'-methylaminofluoran, 3,7-diethylaminofluoran, 7-diethylamino-3-dibenzylaminofluoran, 7-diethylamino-3-methylbenzylaminofluoran, 7-diethylamino-3-chloroethylmethylaminofluoran, 7-diethylamino-3-diethylaminofluoran, etc.; thiazine type compounds such as benzoyl leucomethylene blue, p-nitrobenzyl leuco methylene blue, etc.; spiro type compounds such as 3-methyl-spiro-dinaphthopyran, 3-ethylspiro-dinaphthopyran, 3,3'-dichloro-spiro-dinaphthopyran, 3-benzyl-spiro-dinaphthopyran, 3-methylnaphtho-(3-methoxybenzo)-spiro-pyran, 3-propylspiro-dibenzopyran, etc.; or a mixture thereof.

These color formers are encapsulated by dissolving them in a solvent.

Natural or synthetic oils can be employed as a solvent, individually or in combination. Specific examples of suitable solvents include cotton seed oil, paraffin, naphthene oil, alkylated biphenyls, alkylated terphenyls, chlorinated paraffins, alkylated naphthalenes, etc.

The method of encapsulation has been described hereinbefore.

Examples of suitable binders which can be employed in the present invention are latexes such as styrene-butadiene-rubber latex, styrene-butadiene-acrylonitrile latex, styrene-maleic anhydride copolymer latex, etc.; water-soluble natural high molecular weight materials such as proteins (for example, gelatin, gum, arabic, albumin, casein, etc.), celluloses (for example, carboxymethyl cellulose, hydroxyethyl cellulose, etc.), saccharides (for example, agar, sodium alginate, starch, carboxymethylated starch, etc.); water-soluble synthetic high molecular weight materials such as polyvinyl alcohol, polyvinyl pyrrolidone, polyacrylic acid, polyacryl amide, etc.; organic solvent-soluble high molecular weight materials such as nitrocellulose, ethyl cellulose polyesters, polyvinyl acetate, polyvinylidene chloride, vinyl chloridevinylidene chloride copolymers, etc. It is advantageous that these high molecular weight materials which are used as binders in general have a molecular weight of about 1,000 to about 10,000,000, preferably 10,000 to 5,000,000.

The protective agent which may optionally be used in accordance with the present invention generally has a solid particle or fiber form at room temperature. Examples of such protective agents are starch particles (see British Pat. No. 1,232,347), fine polymer powders (see U.S. Pat. No. 3,625,736), microcapsule particles (not including the color developer-see British Pat. No. 1,235,991), inorganic pigments such as talc, kaolin, bentonite, pyrothyllide, zinc oxide, titanium oxide, alumina, etc. and fine cellulose powders (see U.S. Pat. No. 3,625,736). A suitable particle size for the protective agents having a particulate form is a volume average diameter of about 3 to about 50 microns, preferably 5 to 40 microns. These protective agents are especially effective when their particle size is larger than the microcapsule containing color developer. Where the protective agent is a fiber, a suitable fiber length is about 50 to 600 microns, preferably 100 to 400 microns.

In the case of a self-contained type pressure-sensitive copying paper, a coated layer containing a color developer is coated on a coated layer containing microcapsules thereby to protect the microcapsules. Therefore, no protective agent is needed in this case as discussed above.

The color developer used in the present invention is a material which has the property of accepting an electron or donating a proton and it is an adsorptive or reactive compound which causes a color to be formed on contact with the above-mentioned color former. Suitable examples of color developers include clays, phenol resins, metal salts of aromatic carboxylic acids and the like. Examples of clays are acid clay, active clay, attapulgite, zeolite, bentonite, kaolin, and the like. Of these, clays having a three layer structure, i.e., an acid clay, an active clay, etc., have a high color developing capability and are preferred. While some effects are achieved with other clays, their color developing capability is poorer than a clay having a three layer structure, for example, an acid clay or an active clay.

The phenol resin is a proton-donating phenol resin and is generally well known in the art. Specific examples include a phenol-aldehyde polymer (the so-called novolac type) and a phenol-acetylene polymer.

Specific examples of these phenol resins are a p-phenylphenol-formaldehyde polymer, a p-fluorophenolformaldehyde polymer, a p-chlorophenol-formamide polymer, a p-iodophenol-formaldehyde polymer, a p-nitrophenolformaldehyde polymer, a p-carboxyphenol-formaldehyde polymer, a p-carbalkoxyphenol-formaldehyde polymer, a p-aroylphenolformaldehyde polymer, a p- lower alkoxyphenol-formaldehyde polymer, a copolymer of a mixture containing two or more of p-alkyl(containing 1 to 12 carbon atoms)phenols or isomers thereof with formaldehyde, with examples of suitable p-alkylphenols being p-methylphenol, p-ethylphenol, p-(n-propyl)-phenol, p-isopropylphenol, p-(n-amyl)-phenol, p-isoamylphenol, p-cyclohexylphenol, p-(1,1-dimethyl-n-propyl)phenol, p-(n-hexyl)phenol, p-isohexylphenol, p-(1,1-dimethyl-n-butyl)phenol, p-(1,2-dimethyl-n-butyl)phenol, p-(n-heptyl)phenol, p-isoheptylphenol, p-(5,5-dimethyl-n-amyl)phenol, p-(1,1-dimethyl-n-amyl)phenol, p-(n-octyl)phenol, p-(1,1,3,3-tetramethylbutyl)phenol, p-isooctylphenol, p-(n-nonyl)-phenol, p-isononylphenol, p-(1,1,3,3-tetramethylamyl)-phenol, p-(n-decyl)phenol, p-isodecylphenol, p-(n-undecyl)phenol, p-isoundecylphenol, p-(n-dodecyl)-phenol, etc. In addition, the resin likewise behaves even if an m-substituted group is present, in addition, in the above-mentioned p-substituted phenols. It is not critical to add the m-substituted group thereto and, further the p-substituent and the m-substituent can be the same or different.

Suitable aromatic carboxylic acids which can be used in the aromatic carboxylic acid metal salts includes those represented by the general formula (I):

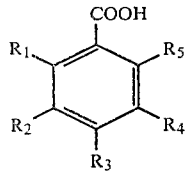

(I)

wherein $R_1$, $R_2$, $R_3$, $R_4$ and $R_5$ each represents a group such as hydrogen atom, a hydroxy group, a halogen atom, amino group, alkylamino group, a nitro group, aldehyde group, an alkyl group, a cycloalkyl group, an aryl group, an alkylaryl group, an aralkyl group, and an alkoxy group, the aforesaid groups containing 18 carbon atoms or less. $R_1$ and $R_2$, or $R_3$ and $R_4$ can combine to form a ring and may form 5-membered ring or 6-membered ring.

Of the compounds as represented by the above described general formula, the compounds in which $R_1$ is represented by a hydroxy group and at least one of ortho- and para-position to the hydroxy group are represented by an alkyl group, an aryl group, an aralkyl group, etc., are particularly suitable for the present invention.

Specific examples of aromatic carboxylic acids include 2,4-dichlorobenzoic acid, p-isopropylbenzoic acid, 2,5-dinitrobenzoic acid, p-tert-butylbenzoic acid, N-phenylanthranilic acid, 4-methyl-3-nitrobenzoic acid, salicyclic acid, m-hydroxybenzoic acid, p-hydroxybenzoic acid, 3,5-dinitrosalicylic acid, 5-tert-butylsalicylic acid, 3-phenylsalicylic acid, 3-methyl-5-tert-butylsalicylic acid, 3,5-di-tert-butylsalicylic acid, 3-cyclohexylsalicylic acid, 5-cyclohexylsalicylic acid, 3-methyl-5-isoamylsalicylic acid, 5-isoamylsalicylic acid, 3,5-di-sec-butylsalicylic acid, 5-nonylsalicylic acid, 2-hydroxy-5-tert-butylbenzoic acid, 2-hydroxy-3-methylbenzoic acid, 2,4-cresotinic acid, 5,5-methylene disalicylic acid, acetamidobenzoic acid (o, m, and p), 2,4-dihydroxybenozic acid, 2,5-dihydroxybenzoic acid, anacardic acid, 1-naphthoic acid, 2-naphthoic acid, 1-hydroxy-2-naphthoic acid, 2-hydroxy-3-naphthoic acid, 2-hydroxy-1-naphthoic acid, thiosalicylic acid, 2-carboxybenzaldehyde, etc.

Further, any olefin or styrene derivatives of the above compounds compounds having about 4 to 18 carbon atoms. Specific examples of the compounds added olefin, styrene derivatives include 3,5-di-(α-methylbenzyl)salicylic acid, 3-(α-methylbenzyl)-5-(α,α-dimethylbenzyl)salicylic acid, 3-(4'-α',α'-dimethylbenzyl)phenyl-5-(α,α-dimethylbenzyl)salicylic acid, 3-cyclohexyl-5-(α,α-dimethylbenzyl)salicylic acid, 3-phenyl-5-(α,α-dimethylbenzyl)-salicylic acid, 3,5-di(α,α-dimethylbenzyl)salicylic acid, etc. Of these compounds, 3,5-di-(α-methylbenzyl)salicylic acid, 3-(α-methylbenzyl)-5-(α,α-dimethylbenzyl)salicylic acid, 3-(4'-α',α'-dimethylbenzyl)phenyl-5-(α,α-dimethylbenzyl)salicylic acid, 3-cyclohexyl-5-(α,α-dimethylbenzyl)salicylic acid, 3-phenyl-5-phenyl-5-(α,α-dimethylbenzyl)salicyclic acid, 3,5-di(α,α-dimethylbenzyl)salicylic acid, 3,5-di-tert-butylsalicylic acid, 3,5-di-tert-octylsalicylic acid, 3,5-di-cyclohexyl salicylic acid are particularly suitable for use in the present invention.

On the other hand, examples of suitable multivalent metal which react with the aromatic carboxylic acids to make metal salts include magnesium, aluminum, calcium, scandium, titanium, vanadium, chromium, maganese, iron, cobalt, nickel, copper, zinc, gallium, germanium, strontium, yttrium, zirconium, molybdenum, silver, cadmium, indium, tin, antimony, barium, tungsten, lead, bismuth, etc. Of these metals, zinc, tin, aluminum, magnesium and calcium are particularly effective. Of these metals, zinc is most effective.

On the other hand, examples of suitable water-soluble metal salts which react with alkali metal salts of the aromatic carboxylic acids include the hydrochlorides, sulfates, nitrates and the like of metals which belong to Group IB such as copper, silver, etc.; Group IIA such as magnesium, calcium, etc.; Group IIIA such as aluminum, gallium, etc.; Group IVA such as tin, lead, etc.; Group VIB such as chromium, molybdenum, etc.; Group VIIB such as manganese, etc.; Group VIII such as cobalt, nickel, etc., of the Periodic Table. Of these metal salts, the hydrochlorides, sulfates and nitrates of zinc, tin, aluminum, magnesium, and calcium are particularly effective.

Of these various color developers mentioned above, the use of clays provides particularly good results.

The color developers as described above can also be used in combination, if desired.

In the present invention, the coating solution containing a color developer as a main component refers to a liquid in which a color developer is dissolved or dispersed in water or another solvent(s) together with a binder for the color developer and generally refers to a liquid which is adjusted to a solid component concentration of about 10 to about 60 wt %.

As a binder for the color developer, a latex type binder such as an acrylic acid ester type latex, a vinyl acetate type latex, a styrene-butadiene type latex, and the like is generally used. A styrene-butadiene latex having an average polymerization degree of 500 to 100,000 is preferred. A suitable amount of the binder is greater than about 5 parts by weight based on 100 parts by weight of the color developer, preferably 10 to 30 parts by weight. Where a latex type binder is employed, other water-soluble binders can also be used in combination. By use of such a combination the strength of a coated layer and dispersibility and the like of a color developer can be improved.

Examples of suitable water-soluble binders which can be used in combination include water-soluble natural high molecular weight materials such as proteins (for example, gelatin, albumin, casein, etc.), celluloses (for example, carboxymethyl cellulose, hydroxyethyl cellulose, etc.), saccharides (for example, agar, sodium alginate, carboxymethylated starch, gum arabic, etc.); water-soluble synthetic high molecular weight materials such as polyvinyl alcohol, polyvinylpyrrolidone, polyacrylic acids, polyacrylamides, etc., and other latexes.

In this case, the amount used is preferably less than about 20 parts by weight based on 100 parts by weight of the color developer and the total amount of binders is preferably less than about 40 parts by weight per 100 parts by weight of the color developer. An amount greater than about 40 parts by weight is not preferred in view of the decrease in color developing capability and the cost.

Water is the most common as a solvent in which a color developer and a binder for the color developer is dissolved or dispersed. In addition, an organic solvent such as methyl ethyl ketone, ethyl acetate, benzene, toluene, etc., can also be employed.

Examples of suitable wets (supports) which can be utilized in the process of the present invention include fine quality, middle quality paper, machine coated paper, art paper, cast coated paper, synthetic paper, synthetic resin coated paper, synthetic resin films, etc. More specifically, the web used in this invention can be freely selected from those conventionally used in the art and includes, for example, a paper, a synthetic resin film, a resin coated paper, a synthetic paper, and the like. The microcapsule layer is coated on at least one side of the support. Examples of suitable synthetic resin films include, for example, polyolefins such as polyethylene, polypropylene; vinyl polymers such as polyvinyl acetate, polyvinyl chloride, polystyrene; polyamides such as nylon-6,6, nylon-6; polyesters such as polyethylene terephthalate, polyethylene-2,6-naphthalate; polycarbonate; cellulose acetates such as cellulose triacetate, cellulose diacetate, etc. Suitable resins which can be used to coat papers to form resin coated papers include polyolefins such as polyethylene, polypropylene, etc.

In the present invention, a suitable coating amount of the coating solution containing the microcapsules as a main component is greater than about 4 g/m$^2$ on a dry basis, preferably 5 to 8 g/m$^2$. A suitable coating amount of the coating solution containing the color developer as a main component, while such will vary depending upon the kind of the color developer, is greater than about 4 g/m$^2$ when using clays, preferably 5 to 8 g/m$^2$, and when using phenol resins or metal salts of aromatic organic carboxylic acids as a color developer, a suitable amount is greater than about 0.5 g/m$^2$, preferably 0.8 to 3 g/m$^2$.

In the present invention, the height of the free-fall vertical curtain is generally less than about 40 cm, preferably less than 30 cm, more preferably about 10 to about 20 cm, although this will vary depending upon the amount of coating solution to be supplied.

In accordance with the present invention, advantageous effects can be obtained and some of these are suumarized below.

(i) The coating solutions with amounts being preset are coated on a web without adjusting the amount of the coating solutions coated by scraping off after coating so that there is no chance of a loss of microcapsule-protecting function by a protective agent due to a selective scraping off of the protective agent because of a classification effect and the function of the protective agent can be sufficiently exhibited and undesired coloration because handling other than that when appropriately used for, e.g., letter marking can be prevented.

(ii) Even where the coating solutions which are supplied but not used for coating are recirculated for reuse, the compositions of the coating solutions recirculated do not change with the passage of time since there is no substantial change in composition between the coating solutions originally supplied and the recycled coating solutions. Therefore, even if coating is continued for a long period of time, no problem arises and it becomes possible to prepare a high quality pressure-sensitive copying paper economically.

(iii) The coating solutions are coated on a web after pre-measuring the coating solutions in a necessary amount, which does not involve the operation of coating an excess amount of the coating solutions on a web and thereafter determining the necessary amount by scraping the excess amount off. Accordingly, permeation of the excess coating solutions into a web to swell the web and as a result copying efficiency as a pressure-sensitive copying paper is damaged, does not occur.

(iv) Since the present invention does not involve the operation of adjusting the amount of the coating solutions by scraping off after coating but a pre-determined amount of coating solutions is coated on a web in the present invention, the formation of a mist as in the air knife coating method is not observed nor does abrasion of the blade as in the blade coating method occur.

(v) Where the coated layers are formed by forming a free-fall vertical curtain of a coating solution containing microcapsules as a main component and coating it on a web to form a coated layer and then forming a free fall vertical curtain of a coating solution containing a color developer as a main component and coating it on the web to form another coated layer while the first coated layer is still undried results in the ability to simplify the drying step. Therefore, a self-contained type pressure-sensitive copying paper can be prepared economically.

(vi) Where a self-contained type pressure-sensitive copying paper is prepared by a simultaneous coating which comprises coating by forming free-fall vertical curtains of dual layers of the coating solution containing microcapsules as a main component and the coating solution containing a color developer as a main component, a self-contained type pressure-sensitive copying paper can b e obtained with a more compact apparatus as compared with the case where each of the coated layers is sequentially formed. In addition, since the amount of the coating solutions supplied to the free-fall vertical curtains can be reduced so that not only can a swelling of the web be prevented but also the drying load can be reduced.

(vii) In the generally applied pressure range defined above the pressure-sensitive copy paper prepared in accordance with the present invention possesses high coloring density and a remarkable increase in P-D property over the pressure-sensitive copying paper prepared in accordance with the air-knife coating or the blade coating method.

(viii) The pressure-sensitive copying paper prepared in accordance with the present invention has excellent smoothness and suitable printing quality without the conventional smoothing treatments.

(ix) When a self-contained pressure-sensitive copying paper is prepared in accordance with the present invention, the coating solution can be prepared without a protective agent and the cost of producing the paper can be reduced.

In order to demonstrate the effects in accordance with the present invention, examples thereof are shown herebelow, in which all parts are parts by weight and all percents are percents by weight, and the coated amounts are all on a dry basis.

EXAMPLE 1

In 30 parts of water at 40° C. were dissolved 6 parts of pig skin acid-treated gelatin and 6 parts of gum arabic. 30 parts of a diisopropyl naphthalene oil having dissolved therein 2.5% crystal violet lactone and 2% benzene leuco methylene blue to which 0.2 part of sodium nonylbenzene sulfonate was added were added to the solution mentioned above and emulsified. To the emulsion was added 200 parts of water at 40° C. While continuing the stirring, a 20% hydrochloric acid aqueous solution was dropwise added to the emulsion to adjust the pH to 4.4. The resulting solution was cooled to 10° C. Thereafter, 2.0 parts of a 37% formaldehyde aqueous solution was added and then 20 parts of a 7% aqueous solution of sodium carboxymethyl cellulose was added to the solution. Further, a 10% sodium hydroxide aqueous solution was added to adjust the pH to 10. 10 parts of cellulose fibers (average length: 200μ; average width: 30μ) and 4 parts of arrowroot starch (average particle size: 40μ) were further added to the solution to obtain a coating solution comprising microcapsules as a main component. The solution had a viscosity of 20 cp at room temperature (22° C.).

The thus-obtained coating solution was supplied into a supplying head in a supplying amount of 1.8 l/min using an extrusion coating apparatus having a slit of a length of 180 mm and a separation width of 0.3 mm as shown in FIG. 1 and FIG. 2, thereby to form a free-fall vertical curtain of a height of 15 cm. A web composed of a thin paper sheet of a width of 150 mm and weighing 40 g/m$^2$ continuously running at 300 m/min was passed through the curtain and the coated web was then dried to obtain a pressure-sensitive copying paper. The thus-obtained pressure-sensitive copying paper had a dry solid coating content of 6.0 g/m$^2$.

The pressure-sensitive copying paper did not color on handling other than letter marking and no stain was observed.

EXAMPLE 2

In 30 parts of diisopropyl naphthalene oil having dissolved therein 2.5% crystal violet lactone and 2% benzene leucomethylene blue were dissolved 5 parts of an adduct of 3 mols of tolylene diisocyanate and 1 mol of trimethylol propane and 1 part of Aktocol XS-550C (trade name, made by Takeda Pharmaceutical Industry Co., Ltd.; a polyhydroxy compound, an adduct sorbitol and propylene oxide; hydroxyl value: 550), as a wall forming material. The oily solution was gradually poured into a solution of 15 parts of polyvinyl alcohol in 120 parts of water at 20° C. to form an oil-in-water type emulsion. While continuing the stirring, 50 parts of water at 40° C. was added to the emulsion. Thereafter, the temperature of the system was gradually increased to 90° C. and kept at 90° C. for an additional 20 minutes to complete the encapsulation. Thus, a solution containing 40% diisopropyl naphthalene was obtained. The solution was further diluted with 60 parts of water to obtain a coating solution containing microcapsules as a main component.

Separately, 100 parts of acid clay as a color developer was added to a solution obtained by adding 8 parts of a 20% by weight aqueous sodium hydroxide solution to 300 parts of water. After vigorously stirring to disperse the mixture, 20 parts of a styrene-butadiene rubber latex as a binder for the color developer was added to the dispersion to prepare a coating solution containing the color developer as a main component. The solution had a solid content of 22% and a viscosity of 10.8 cp at 22° C.

The thus-obtained two kinds of coating solutions were coated onto a continuously running web of a thin paper sheet of a width of 150 mm and weighing 40 g/m$^2$ and running at 240 m/min by supplying the coating solution containing microcapsules as a main component at 1.4 l/min and the coating solution containing the color developer as a main component at 1.1 l/min in a supplying head, respectively, to form dual layer free-fall vertical curtains of a height of 20 cm, each layer being in surface-to-surface contact. The coated layers were dried to obtain a self-contained type pressure-sensitive copying paper.

The pressure-sensitive copying paper contained a uniform dry solid coating amount of 12 g/m$^2$. No mixing was substantially present between the coated layers. The pressure-sensitive copying paper exhibited quite the same coloration capability as a conventional self-contained type pressure-sensitive copying paper.

EXAMPLE 3

In 30 parts of a diisopropyl naphthalene were dissolved 2.5% crystal violet lactone as a color developer and 2% benzene leuco methylene blue at 90° C. After cooling this oily solution until 20° C., 5 parts of Desmodur L-75 (trade name, made by Bayern A.G.; 75% solution comprising ethyl acetate dissolved 3 mols of tolylene diisocyanate and adduct of 1 mol of trimethylol propane; M.W. about 760) and 2 parts of Takenate D-153 (trade name, made by Takeda Pharmaceutical Industry Co., Ltd.; 25% solution comprising ethyl acetate dissolved 2 mols of tolylene diisocyanate and adduct of 1 mol of dipropylene glycol) were added and dissolved in the oily solution for preparing the first wall forming material. 0.5 part of Aktocol IR-45 (trade name, made by Takeda Pharmaceutical Industry Co., Ltd.; an adduct of ethylenediamine and propyleneoxide) as the second wall forming material was added and dissolved in the solution prepared above. The oily solution obtained above was added into a solution of 0.2 part of Turkey red oil, 3 parts of gum arabic and 2 parts of polyvinyl alcohol in 60 parts of water at 18° C. with stirring rapidly to form oil-drops having a diameter of 6–10μ. Thereafter, the temperature of the system was gradually increased to 90° C. and kept at 90° C. for an additional 20 minutes to complete the encapsulation.

6 parts of cellulose flocks (average length: about 200μ; average width: about 30μ) as a protective agent and 37 parts of water were further added to the solution to obtain a coating solution A. A solid content concentration of the coating solution A was 33%.

On the other hand, 25 parts of water was only added into the solution encapsulated to obtain a coating solution B. A solid content concentration of the coating solution B was 33%.

Separately, 110 parts of acid clay was added to a solution obtained by adding 8 parts of 20% by weight aqueous sodium hydroxide solution to 300 parts of water. After vigorously stirring to disperse the mixture, 20 parts of a styrene-butadiene rubber latex was added to prepare a coating solution C containing the color developer as a main component. The coating solution C had a solid content concentration of 27.5% and a viscosity of 19.5 cp at 22° C.

Further, 110 parts of acid clay was added to a solution obtained by adding 8 parts of 20% by weight aqueous sodium hydroxide solution to 200 parts of water. After vigorously stirring to disperse the mixture, 20 parts of a styrene-butadiene rubber latex was added to prepare a coating solution D containing the color developer as a main component. The coating solution D had a solid content concentration of 35.6% and a viscosity of 300 cp at 22° C.

The thus-obtained coating solutions A, B, C and D were coated onto a high quality paper sheet of weighing 50 g/m$^2$ in the manner and under the conditions shown in Table 1. The coated layers were dried by ordinary hot wind and wound up to obtain a pressure sensitive copying paper.

In the case of air-knife coating, the coating solutions A, B and C were diluted by adding water to prepare the solid content concentration of these solutions of 18%, 18% and 22% respectively. Since it was impossible to scrape off by the air-knife unless these coating solution were diluted.

In the case of preparing a self-contained pressure sensitive copying paper by air-knife and blade coating (#7, #8, #11 and #12), after drying the sheet coated with the coating solution A or B containing the color developer as a main component, the coated sheets were wound up and unwound one time, then the sheets were coated with solutions C or B as shown in the Table.

TABLE 1

| Sample | Coating Solution | Coating Manner | Coating Amount(g/m$^2$) |
|---|---|---|---|
| #1 | A | Air-Knife Coating | 4.8 |
| #2 | B | " | 4.5 |
| #3 | A | Curtain Coating | 4.8 |
| #4 | B | " | 4.5 |
| #5 | A | Blade Coating | 4.8 |
| #6 | B | " | 4.5 |
| #7 | A and C | Air-Knife Coating | A : 4.8, C : 5.5 |
| #8 | B and C | " | B : 4.5, C : 5.5 |
| #9 | A and C | Curtain Coating | A : 4.8, C : 5.5 |
| #10 | B and C | " | B : 4.5, C : 5.5 |
| #11 | A and D | Blade Coating | A : 4.8, D : 5.5 |
| #12 | B and D | " | A : 4.5, D : 5.5 |

For curtain coating, an extrusion coating apparatus having a slit of a length of 800 mm and a slit width of 0.4 mm (two slits were used for #9 and #10) was used. Sheets #3 and #4 were conveyed at 600 m/min and sheets #9 and #10 were conveyed at 300 m/min. Supply amount to a supplying head was 7.2 l/min for samples #3 and #4, 3.4 l/min for coating solution A and 4.7 l/min for coating solution C for sample #9; and 3.3 l/min for coating solution B and 4.8 l/min for coating solution C for sample #10.

For the air-knife coating, the coating solution was coated by operating a coating roller having diameter of 400 mm in the reverse direction of the high quality paper sheet which was continuously running. Then, the coated layer was metered by blowing air at a pressure of 2500 mm $H_2O$ from an air-nozzle having a slit width of 0.8 mm.

For the blade coating, the coating solution was coated on the high quality paper sheet which was continuously running at 300 m/min in a fountain coating method. Then, the coated layer was metered by a blade of leaf spring made of steel having thickness of 0.4 mm.

Figure 5:
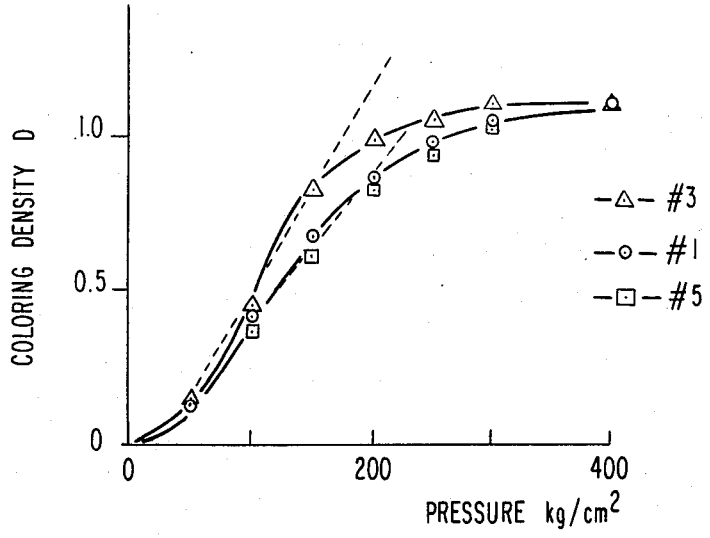
FIG. 5 and FIG. 6 each shows performance characteristics of pressure-sensitive copying papers produced in accordance with this invention.
Figure 6:
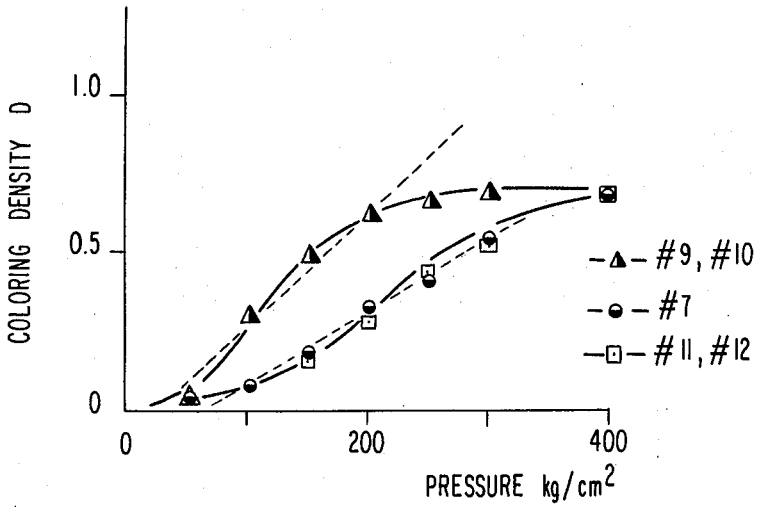

The thus-obtained Samples #1 to #12 were measured for P-D property, surface quality and fog, and the results obtained are shown in Table 2, FIG. 5 and FIG. 6. The surface quality was measured using a Beck's type smoothness meter. Fog was metered by observing the soil at the surface of the samples with the naked eye. The P-D property, for #7 to #12, was measured by using a spectrophotometer (measuring wave length: 610 mm) after pressure coloring the samples with a pressure coloring tester. On the other hand, Samples #1 to #6 were interleaved with a standard color developer sheet which was prepared by coating the solution C in an amount of 5.5 g/m$^2$ on a paper sheet weighing 50 g by means of air-knife coating method and calendering to obtain a smoothness of 50 sec by Beck's type smoothness tester. Then, the samples interleaved with the color developer sheet were subjected to color formation using a coloring tester. The measurement for density was conducted in the same manner as #7 to #12.

TABLE 2

| Sample | P-D Property | Smoothness (sec.) | Fog |
|---|---|---|---|
| #1 | FIG. 5 | 8 | — |
| #2 | — | 20 | — |
| #3 | FIG. 5 | 30–45 | — |
| #4 | — | 50 | — |
| #5 | FIG. 5 | 30–50 | — |
| #6 | — | 30–60 | — |
| #7 | FIG. 6 | 16 | good |
| #8 | — | 20–30 | bad |
| #9 | FIG. 6 | 50 | good |
| #10 | FIG. 6 | 50 | good |
| #11 | FIG. 6 | 50 | bad |
| #12 | FIG. 6 | 50 | extremely bad |

it can be seen from Table 2 above that the samples #1, #2, #7, #3 prepared by air-knife coating have poor surface smoothness and printing property but, on the other hand, the Samples #3, #4, #9, #10 prepared by the present invention have excellent surface smoothness and printing property.

Further, the Samples #11 and #12 prepared by blade coating show that commercial value is extremely decreased by breaking microcapsules and the appearance of fog. On the other hand, for the Samples #9, #10 prepared by the present invention, fog does not appear at all. The different amounts of fog observed for samples #7 and #8 prepared by air-knife coating is believed to be attributed to the fact that microcapsule solution B used for #8 did not contain the protective agent but the solution A used for #7 contained the protective agent. However, fog does not occur in Sample #10 prepared in accordance with the present invention in spite of the lack of protective agents in the capsule solution.

Furthermore, it can be seen from FIG. 5 that Sample #3 prepared in accordance with the present invention exhibited high coloring density within the applied pressure range of 100 to 400 kg/cm$^2$ as opposed to Samples #1 and #5 prepared in accordance with the air-knife coating and the blade coating respectively. In addition, the Sample #3 exhibited sharp coloring and superior P-D property within the most generally used pressure range of 50 to 250 kg/cm$^2$ as opposed to Samples #1 and #5.

FIG. 6 shows that this tendency is especially true for a self-contained type pressure-sensitive copying paper, the coloring density of Samples #9 and #10 prepared in accordance with the present invention is about twice that of the Sample #7 prepared in accordance with the air-knife coating and the Samples #11 and #12 prepared in accordance with the blade coating at the applied pressure of 200 kg/cm$^2$. In addition, the Samples #9 and #10 exhibited superior P-D property and extremely sharp coloring with the most generally used pressure range of 50 to 250 kg/cm$^2$ in comparison to Samples #7, #11 and #12. FIG. 6, Samples #9 and #10 are shown on the same curved line since they exhibit essentially equivalent pressure and density properties. Samples #11 and #12 were also drawn on the same line.

What is claimed is:

1. A process for producing a pressure-sensitive copying paper which compries forming a single-layer, free-fall, vertical curtain of a coating solution containing microcapsules as a main component, said microcapsules containing a color former therein, and coating said coating solution onto a continuously running web by passing said running web through said single-layer, free-fall, vertical curtain.

2. A process for producing a pressure-sensitive copying paper which comprises forming a dual-layer, free-fall, vertical curtain of a layer of a coating solution containing microcapsules as a main component, said microcapsules containing a color former therein, and a layer of a coating solution containing a color developer as a main component, and coating said coating solutions onto a continuously running web by passing said running web through said dual-layer, free-fall, vertical curtain.

3. A process for producing a pressure-sensitive copying paper which comprises forming a first single-layer, free-fall, vertical curtain of a coating solution containing microcapsules as a main component, said microcapsules containing a color former therein, and a second single-layer, free-fall, vertical curtain of a coating solution containing a color developer as a main component, and coating said coating solution containing microcapsules as a main component onto a continuously running web by passing said running web through said first single-layer, free-fall, vertical curtain to form a coated layer, and then coating said coating solution containing a color developer as a main component onto the coated layer on said web in a superposed relationship while the previously formed coated layer on said web is in an undried and unsolidified state by passing said coated running web through said second single-layer, free-fall, vertical curtain.

4. The process of claim 1, wherein said single-layer, free-fall, vertical curtain has a height of less than about 40 cm.

5. The process of claim 1, wherein said microcapsules have an average particle size of about 0.1 to about 100 microns.

6. The process of claim 2, wherein said color developer is an electron-accepting or proton-donating material and causes a color to be formed on contact with a color former.

7. The process of claim 6, wherein said color developer is a clay, a phenol resin or an aromatic carboxylic acid metal salt.

8. The process of claim 7, wherein said aromatic carboxylic acid has the general formula (I):

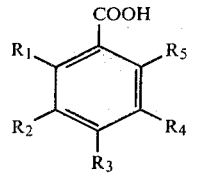

(I)

wherein $R_1$, $R_2$, $R_3$, $R_4$ and $R_5$ each represents a hydrogen atom, a hydroxy group, a halogen atom, an amino group, an alkylamino group, a nitro group, an aldehyde group, an alkyl group, a cycloalkyl group, an aryl group, an alkylaryl group, an aralkyl group, or an alkoxy group, the aforesaid group containing 18 carbon atoms or less; and two of $R_1$, $R_2$, $R_3$, $R_4$ and $R_5$ in adjacent positions can combine to form a ring.

9. The process of claim 8, wherein $R_5$ is a hydroxy group.

10. The process of claim 1, wherein the coating amount of said coating solution containing microcapsules as a main component is greater than about 4 g/m$^2$ on a dry basis.

11. The process of claim 10, wherein said coating amount is 5 to 8 g/m$^2$.

12. The process of claim 2, wherein said color developer is a clay and the coating amount of said coating solution containing said clay color developer as a main component is greater than about 4 g/m$^2$.

13. The process of claim 12, wherein said coating amount is 5 to 8 g/m$^2$.

14. The process of claim 2, wherein said color developer is a phenol resin or an aromatic carboxylic acid metal salt and the coating amount of said coating solution containing said color developer as a main component is greater than about 0.5 g/m$^2$.

15. The process of claim 14, wherein said coating amount is 0.8 to 3 g/m$^2$.

16. The process of claim 1 wherein said coating solution containing microcapsules does not contain a protective agent.

17. The process of claim 3, wherein said color developer is an electron-accepting or proton-donating material and causes a color to be formed on contact with a color former.

18. The process of claim 1, wherein said color former is an electron-donating or proton-accepting material forming a color on contact with a color developer.

19. The process of claim 2, wherein said color former is an electron-donating or proton-accepting material forming a color on contact with a color developer.

20. The process of claim 3, wherein said color former is an electron-donating or proton-accepting material forming a color on contact with a color developer.

* * * * *